United States Patent [19]

Topp et al.

[11] Patent Number: 4,614,668

[45] Date of Patent: Sep. 30, 1986

[54] METHOD OF MAKING AN ELECTROLUMINESCENT DISPLAY DEVICE WITH ISLANDS OF LIGHT EMITTING ELEMENTS

[75] Inventors: Mark Topp; Sam Hadden, both of Miami, Fla.

[73] Assignee: Cordis Corporation, Miami, Fla.

[21] Appl. No.: 627,284

[22] Filed: Jul. 2, 1984

[51] Int. Cl.[4] ..... H05B 33/10; H05B 33/12; B05D 5/06

[52] U.S. Cl. ..... 427/66; 313/505; 313/509

[58] Field of Search ..... 313/505, 506, 509, 503, 313/511; 427/66; 445/24

[56] References Cited

U.S. PATENT DOCUMENTS

| | | | |
|---|---|---|---|
| 2,877,371 | 3/1959 | Orthuber et al. | 313/108 |
| 2,925,532 | 2/1960 | Larach | 313/503 X |
| 2,938,135 | 5/1960 | Toulon | 313/108 |
| 2,958,009 | 10/1960 | Bowerman, Jr. | 315/169 |
| 2,969,481 | 1/1961 | Sack, Jr. | 315/169 |
| 3,315,111 | 4/1967 | Jaffe et al. | 313/503 |
| 3,631,286 | 12/1971 | Anderson et al. | 313/503 |
| 4,238,793 | 12/1980 | Hochstrate | 340/781 |
| 4,322,720 | 3/1982 | Hughes | 340/825.81 |
| 4,417,174 | 11/1983 | Kamijo et al. | 313/503 X |

OTHER PUBLICATIONS

"Design Guide—Electroluminescent Lighting", by Luminescent Systems Inc., pp. 1 to 69.

*Primary Examiner*—Palmer C. DeMeo
*Assistant Examiner*—Sandra L. O'Shea
*Attorney, Agent, or Firm*—George H. Gerstman

[57] ABSTRACT

An electroluminescent display is provided which comprises a matrix of individual light-emitting elements in a row and column formation and adapted for excitation from a voltage supply which addresses the matrix. The matrix, which is formed on a substrate, includes a plurality of parallel copper conductors etched onto the substrate with each of the conductors forming a column. A plurality of polymer dielectrics are screen printed over the first conductors, with each dielectric corresponding to an individual light-emitting element. A plurality of light-emitting polymer phosphors are screen printed over the dielectrics with each phosphor corresponding to an individual light-emitting element. A polymer indium oxide light-transmissive conductor is screen printed over each phosphor. A conductive silver polymer ink is printed over the light-transmissive conductor with portions of the silver polymer defining window openings for enabling viewing of the phosphor through the light-transmissive layer when the phosphor is excited. Voltage excitation by a dynamic voltage supply across a selected copper conductor and the silver polymer will cause light emission by the light-emitting element at the excited row-column intersection.

24 Claims, 9 Drawing Figures

METHOD OF MAKING AN ELECTROLUMINESCENT DISPLAY DEVICE WITH ISLANDS OF LIGHT EMITTING ELEMENTS

BACKGROUND OF THE INVENTION

The present invention concerns a novel electroluminescent display and, more particularly, an electroluminescent display formed of a matrix of individual light-emitting elements in a row and column formation and adapted for excitation from a voltage supply which addresses the matrix.

Prior art electroluminescent displays are known in which the elements which make up the display layered onto a glass substrate. Typically these elements are applied to the glass substrate using vacuum deposition techniques. Such vacuum deposition techniques require expensive equipment, including an expensive vacuum chamber with high temperature deposition, for example, in the order of 600 C. or higher. Because of the high temperature required, the types of substrates which may be utilized are severely limited. Only certain glass materials are typically used because otherwise there could be significant distortion. Other problems may be created by using vacuum deposition techniques, including pinholing (where there are voids in coverage). Further, the process typically takes an extremely long time to complete the assembly of the electroluminescent display using vacuum deposition/high temperature techniques. Because of the size and expense of the vacuum deposition equipment required, only limited quantities of the displays may be produced over a selected period of time.

We have discovered a novel electroluminescent display that alleviates many of the problems concomitant with electroluminescent displays that are formed using vacuum deposition techniques. According to our invention, an electroluminescent display may be provided without using vacuum deposition techniques and without high temperature requirements.

It is an object of the present invention to provide an electroluminescent display that can be miniaturized into an appropriate form usable in a pixel type arrangement.

Another object of the present invention is to provide an electroluminescent display that can be addressed in a row and column matrix, thereby allowing for the development of appropriate selection of pixels for alphanumeric or other display purposes.

A still further object of the present invention is to provide an electroluminescent display that can be manufactured efficiently, using printed circuit and screen printing techniques, in contrast to prior art thin film sputtering techniques on high temperature glass substrates.

An additional object of the present invention is to provide an electroluminescent display that can be assembled into an extremely thin (for example, less than 0.02 inch) structure and may be flexible in both directions.

Another object of the present invention is to provide an electroluminescent display that can be formed on a large number of different substrates, including relatively thin substrates and also including substrates which cannot normally withstand high temperatures. For example, such substrates which can be used with our invention include conventional fiberglass printed circuit board material, phenolic boards, substrates formed of polyimide film, substrates formed of polycarbonate, substrates formed of fluorohalocarbon film, and others. By the nature of the aforementioned substrates and the elements used in the present invention, the entire electroluminescent display may be flexible and may be extremely thin (for example, less than 0.02 inch).

A still further object of the present invention is to provide an electroluminescent display that can be manufactured using screen printing techniques, with the elements forming the display being curable at low temperatures, such as under 150° C. The substrate may include conventional fiberglass printed circuit board material, a substrate formed of phenolic material, a substrate formed of polyimide film, a substrate formed of polycarbonate, a substrate formed of fluorohalocarbon film, and others. Such substrates used in accordance with the present invention are 0.005 inch in thickness and may be as thin as 0.001 inch if desired.

An additional object of the present invention is to provide an electroluminescent display that effectively operates in the form of light-emitting capacitors, in a manner that provides significant advantages over prior art electroluminescent display techniques.

Other objects and advantages of the present invention will become apparent as the description proceeds.

SUMMARY OF THE INVENTION

In accordance with the present invention, an electroluminescent display is provided comprising a matrix of individual light-emitting elements in a row and column formation and adapted for excitation from a voltage supply which addresses the matrix. The matrix is formed on a substrate and each of the light-emitting elements comprises a first electrical conductor overlying the substrate, a dielectric overlying the first electrical conductor, a light-emitting phosphor overlying the dielectric, and a second electrical conductor overlying the phosphor and defining a window for enabling viewing of the phosphor. In this manner, the voltage excitation by the voltage supply across the first electrical conductor and the second electrical conductor will cause light emission by the excited element.

In the illustrative embodiment, the first conductor comprises a copper layer, the dielectric comprises a polymer barium titanate layer, the phosphor comprises a phosphor polymer layer and the second electrical conductor comprises a conductive silver polymer ink. A light-transmissive polymer electrically conductive layer overlies the phosphor with the second electrical conductor overlying the light-transmissive layer.

In the illustrative embodiment, the first electrical conductors are electrically interconnected to form a column and the second electrical conductors are electrically interconnected to form a row. A plurality of parallel columns are on the substrate and there is also a plurality of parallel rows on the substrate, with the columns and rows being perpendicular to each other.

A more detailed explanation of the invention is provided in the following description and claims, and is illustrated in the accompanying drawings.

DETAILED DESCRIPTION OF THE ILLUSTRATIVE EMBODIMENT

Figure 1:
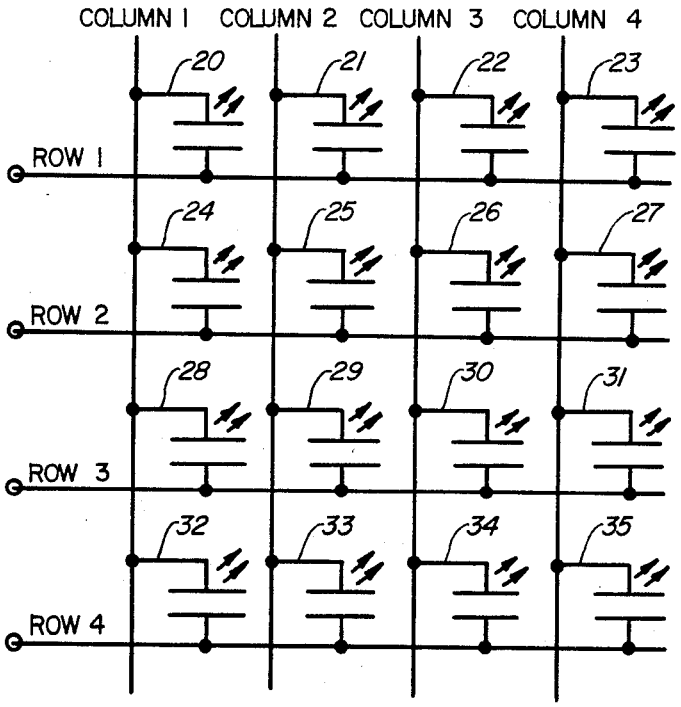
FIG. 1 is a schematic diagram of a matrix of light-emitting elements in accordance with the principles of the present invention.

In FIG. 1 there is shown, schematically, a 4×4 matrix of individual light-emitting elements 20 through 35 in a row and column formation. Elements 20 through 23 are in row 1; elements 24 through 27 are in row 2; elements 28 through 31 are in row 3; and elements 32 through 35 are in row 4. Elements 20, 24, 28 and 32 are in column 1; elements 21, 25, 29 and 33 are in column 2; elements 22, 26, 30 and 34 are in column 3; and elements 23, 27, 31 and 35 are in column 4. Elements 20 through 35 are adapted for excitation from a voltage supply which addresses the matrix, as is discussed below. Elements 20 through 35 are individual pixel points which effectively are capacitors in an array matrix form. Although a 4×4 matrix is illustrated, no limitation is intended with respect to the size of the array matrix. Furthermore, the configuration of the matrix can be such that multi-segment digits can be formed, both multiplexed or direct addressing, and also luminous fixed legends, such as logos, nomenclature, etc. may be used.

Figure 2:
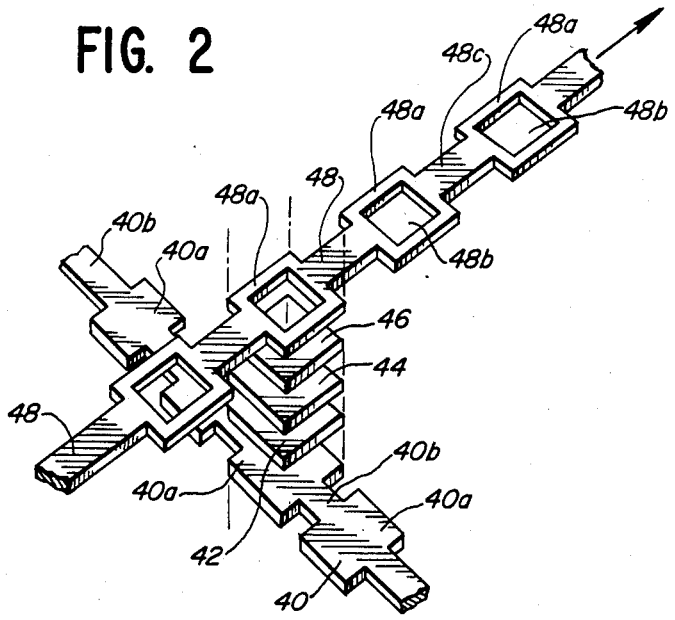
FIG. 2 is a partially broken, exploded, perspective view of a portion of an electroluminescent display constructed in accordance with the principles of the present invention.
Figure 9:
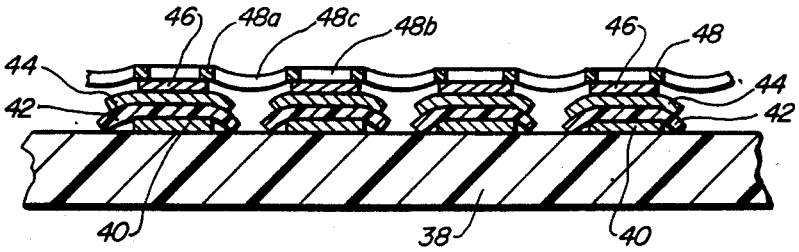
FIG. 9 is a diagrammatic cross-sectional view, taken along the plane of the line 9—9′ of FIG. 3.

The construction of the matrix can be most readily understood by referring to FIG. 2, which shows an exploded perspective view of a portion of the matrix that is printed upon a suitable non-conductive substrate 38 (FIG. 9). FIG. 2 shows a typical pixel at the intersection of one row and one column and includes a foil copper conductor 40 overlying the substrate, a polymer barium titanate dielectric polymer 42 overlying the copper conductor, a phosphor polymer layer 44 overlying the dielectric, a polymer indium oxide translucent polymer conductor 46 overlying the phosphor polymer layer, and a silver polymer electrical conductor 48 overlying the indium oxide translucent polymer. It can be seen that the copper conductor layer 40 comprises a number of large portions **40*a* interconnected by smaller portions 30*b*. Interconnected portions 40*a* and 40*b* form a column, with one of the larger portions 40*a* being the first printed layer of a pixel. It can also be seen that silver polymer conductor 48 comprises large portions 48*a* defining open windows 48*b* and interconnected by smaller portions 48*c*. The interconnected large portions 48*a* and smaller portions 48*c* form a row with one of the large portions 48*a* and its defined window 48*b*** being the top layer of a pixel.

Figure 3:
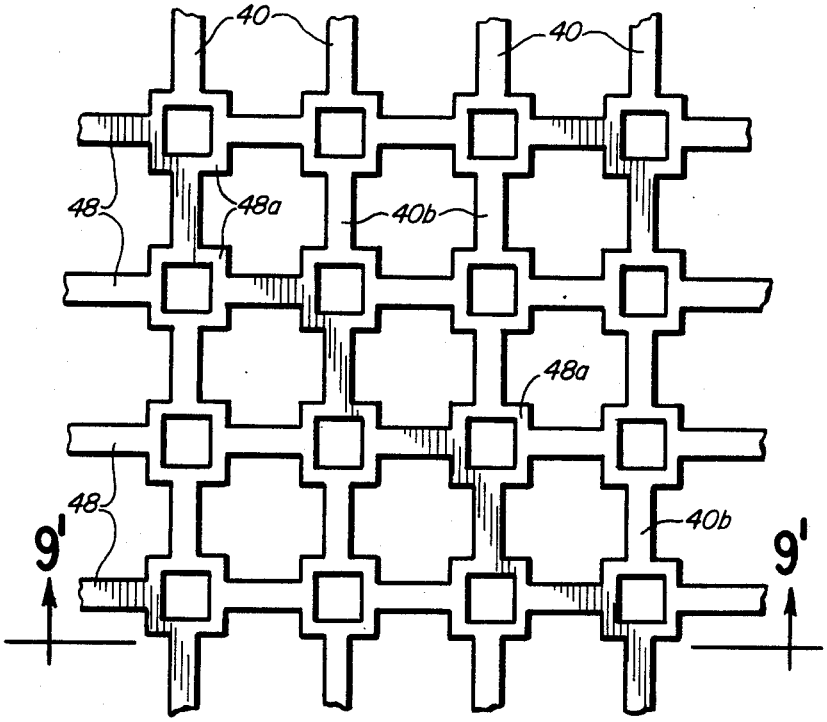
FIG. 3 is a partially broken plan view of an electroluminescent display constructed in accordance with the principles of the present invention.

Referring to FIG. 3, it can be seen that four copper conductor layers 40 are aligned in parallel, spaced relationship to form four columns and four silver polymer conductors 48 are aligned in spaced parallel relationship to each other to form four rows, with the rows and columns being perpendicular to each other and forming an array matrix. Voltage excitation by a voltage supply across a selected copper conductor 40 and a selected silver polymer conductor 48 will cause a light emission by the light-emitting element at the excited row-column intersection, with the phosphor pixel emitting light which is viewed through the pixel window **48*a***.

Figure 4:
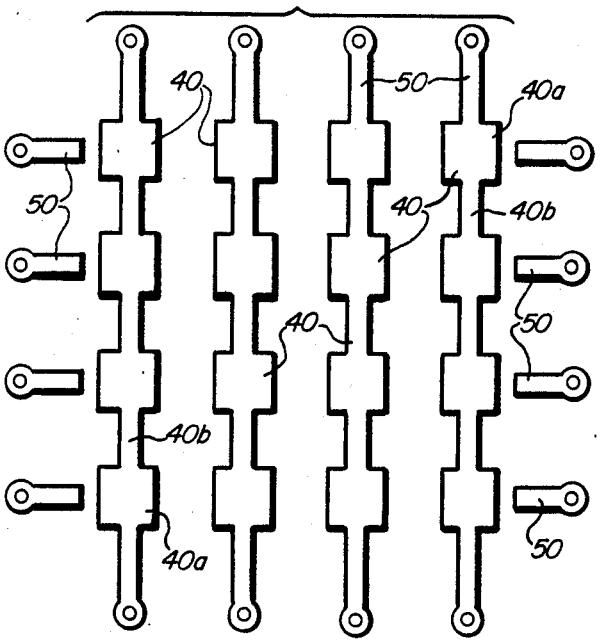
FIG. 4 is a layout diagram of the first electrical conductor of an electroluminescent display constructed in accordance with the principles of the present invention.

FIGS. 4–8 show, in diagrammatic form, the steps of providing the appropriate layers on the substrate. Referring to FIG. 4, the parallel copper layers 40 are provided on a substrate using conventional printed circuit board technology to provide an etched copper pattern as illustrated. End connectors 50 are also etched on the substrate for subsequent contact with the ends of the parallel silver polymer layers. As a specific example, the copper layer may be 0.0012 inch in thickness.

Figure 5:
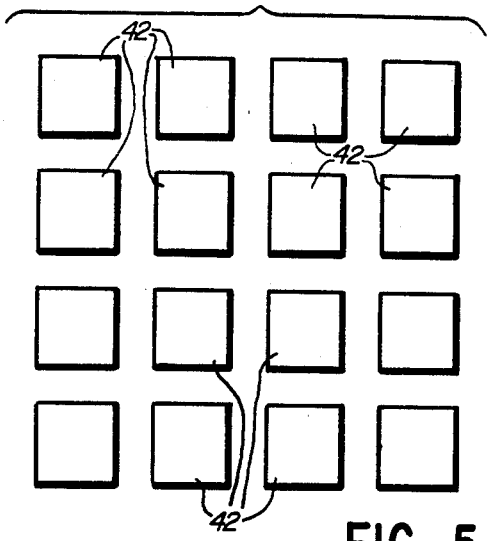
FIG. 5 is a similar layout diagram of the polymer dielectric.

Referring to FIG. 5, a barium titanate dielectric layer 42 is then screen printed on top of the copper layer 40. As a specific example, the dielectric 42 may be about 0.0017 inch in thickness. The dielectric is cured at 105° C. for twenty minutes, and comprises several deposits (with curing between each deposit) to form the 0.0017 inch total layer.

Figure 6:
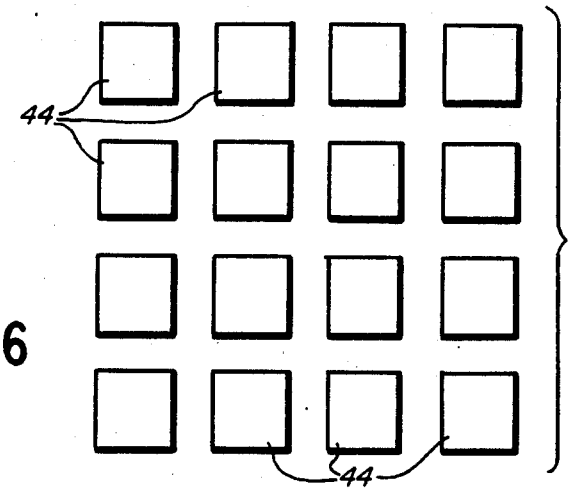
FIG. 6 is a similar layout diagram of the polymer phosphorous layer.

Referring to FIG. 6, a phosphorous layer 44, formed of a suitable phosphor polymer, is screen printed over the dielectric 42. In a specific example, the phosphor polymer layer is about 0.0017 inch in thickness and it is cured at 105° C. for thirty minutes.

Figure 7:
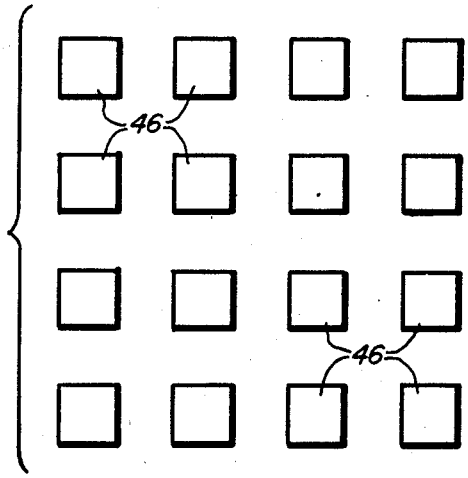
FIG. 7 is a similar layout diagram of the polymer indium oxide layer.

Referring to FIG. 7, an indium oxide translucent polymer 46, which is electrically conductive, is screen printed over phosphorous layer 44. In a specific example, the indium oxide translucent polymer conductor is approximately 8 microns in thickness, and it is cured at 65° C. for twenty minutes.

Figure 8:
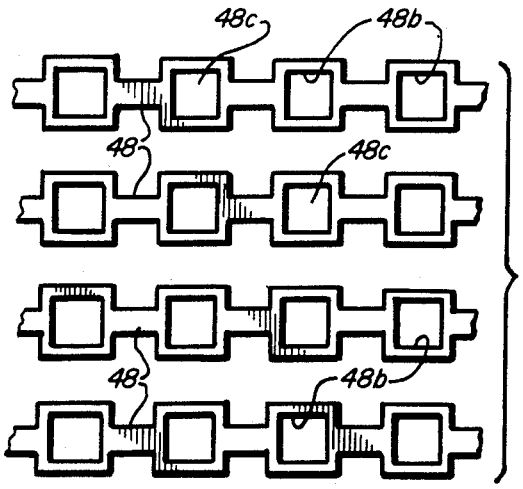
FIG. 8 is a similar layout diagram of the silver polymer ink layer.

Referring to FIG. 8, the silver polymer conductor rows 48 are screen printed on top of the indium oxide layers 46 with each defined window **48*b* directly overlying an indium oxide conductor 46. In a specific example, the interconnecting silver conductor 48 is about 15 microns in thickness, and it is cured at 150° C. for ninety minutes. It is deposited with a 200 mesh/inch screen, in a single deposit, and the ends of the silver conductors 48 overlie and make contact with copper elements 50**, to which interconnecting wires may be soldered.

Referring to FIG. 7, it should be noted that the pattern for the indium oxide elements 46 provides slightly smaller indium oxide squares than the barium titanate dielectric squares 42 and the phosphorous squares 44. This is because the indium oxide layer is electrically conductive and by making the indium oxide squares smaller than the dielectric and phosphorous squares, there will be no short circuit between the copper layers 40 and the indium oxide 46. In this manner, each pixel effectively comprises a capacitor with a barium titanate dielectric layer 42 and a phosphorous layer 44 sandwiched between conductors.

In an alternative embodiment, the silver polymer conductor 48 is screen printed directly over the phosphor polymer 44 and the indium oxide translucent polymer conductor 46 is deposited over the silver polymer conductor 48.

In FIG. 9, there is a cross-sectional view of a row from FIG. 3. To cause the light emission by a pixel, a dynamic voltage is provided across the selected row and selected column to excite the pixel at the row-column intersection. The dynamic voltage may be provided by an alternating current or a pulsed direct current. In a specific example, a pulsed direct current was applied using one-eighth duty cycle rectangular waves at 20 kilohertz having a voltage between 250 and 300 volts. It is to be understood, however, that the parameters of the dynamic voltage that is applied across a row and column can vary considerably. However, using the aforementioned parameters, the pixel emitted a blue cyan color light. This color is pleasing to the eye and is also adaptable for use as the blue phosphor in a color television picture tube.

It can be seen that in the illustrative embodiment, thick film techniques, including etching and screen printing, have been used, in contrast to thin film techniques employing vacuum sputtering and the like. The materials are effectively sealed to prevent moisture from attacking the phosphorous layer.

Although an illustrative embodiment of the invention has been shown and described, it is to be understood that various modifications and substitutions may be made by those skilled in the art without departing from the novel spirit and scope of the present invention. For example, the display may be a fixed legend such as company logo, etc.

What is claimed is:

1. A method of making an electroluminescent display comprising a matrix of individual light-emitting elements in a row and column formation and adapted for excitation from a voltage supply which addresses the matrix, which comprises the steps of:

providing a plurality of first electrical conductors overlying a substrate with each first electrical conductor forming a column;

screen printing a plurality of spaced polymer dielectric islands overlying the first conductors, with each dielectric island corresponding to an individual light-emitting element;

screen printing a plurality of spaced polymer light-emitting phosphor islands overlying the dielectrics; and screen printing a plurality of second electrical conductors overlying said polymer phosphor islands in a direction transverse the direction of the first conductors, with each of said second electrical conductors forming a row;

whereby voltage excitation by the voltage supply across a selected first electrical conductor and second electrical conductor will cause light emission by the light-emitting element at the excited row-column intersection.

2. A method as described in claim 1, wherein said first electrical conductors are provided parallel to each other, said second electrical conductors are screen printed parallel to each other, and said first conductors are perpendicular to said second conductors.

3. A method as described in claim 1, wherein said first conductors are formed of copper that has been etched on the substrate with large area portions corresponding to each light-emitting element and smaller area portions interconnecting the large area portions.

4. A method as described in claim 1, wherein each of said dielectric islands comprises a polymer barium titanate layer that has been screen printed over a first conductor.

5. A method as described in claim 1, including the step of screen printing a polymer indium oxide light-transmissive conductor layer over each said phosphor.

6. A method as described in claim 1, wherein each of said second conductors comprises a screen printed conductive silver polymer ink.

7. A method as described in claim 1, wherein each of said second conductors is formed of an electrically conductive material with first portions defining window openings aligned with each dielectric and second portions interconnecting the first portions.

8. A method as described in claim 1, including the step of providing a light-transmissive conductor overlying said phosphor and with said second conductor overlying said light-transmissive conductor.

9. A method as described in claim 8, whereby said light-transmissive conductor comprises an indium oxide polymer.

10. A method as described in claim 9, wherein said first conductors are formed of copper with large area portions corresponding to each light-emitting element and smaller area portions interconnecting the large areas portions, and each of said dielectrics comprises a polymer barium titantate layer.

11. A method of making an electroluminescent display comprising a matrix of individual light-emitting elements in a row and column formation and adapted for excitation from a voltage supply which addresses the matrix, which comprises the steps of:

providing a plurality of first electrical conductors overlying a substrate with each first electrical conductor forming a column, said first electrical conductors being parallel to each other and being formed of copper with large area portions corresponding to each light-emitting element and smaller area portions interconnecting the large area portions;

screen printing a plurality of spaced polymer dielectric islands overlying the first electrical conductors, with each dielectric island corresponding to an individual light-emitting element and each of said dielectrics comprising a barium titanate layer;

screen printing a plurality of spaced polymer light-emitting phosphor islands overlying the dielectrics with said phosphor comprising a phosphor polymer layer;

screen printing a plurality of indium oxide polymer light-transmissive conductors overlying said phosphor;

screen printing a plurality of second electrical conductors in parallel with each other and overlying said indium oxide polymer conductors in a directon that is perpendicular to the direction of the first electrical conductors, with each second electrical conductor forming a row, each of said second conductors comprising a conductive silver polymer ink and being formed with first portions defining window openings aligned with each dielectric and second portions interconnecting the first portions;

whereby voltage excitation by the voltage supply across a selected first electrical conductor and second electrical conductor will cause light emission by the light-emitting element at the excited row-column intersection.

12. A method of making an electroluminescent display comprising a number of individual light-emitting elements in a selected formation and adapted for excitation from a voltage supply, which comprises the steps of:

providing a plurality of first electrical conductors overlying a substrate;

screen printing a plurality of spaced dielectric polymer islands overlying the first electrical conductors;

screen printing spaced light-emitting phosphor polymer islands overlying the dielectrics;

screen printing second electrical conductors overlying the phosphor islands and defining windows for enabling viewing of the phosphor;

whereby voltage excitation by the voltage supply across the first electrical conductor and the second electrical conductor will cause light emission by the excited element.

13. A method as described in claim 12, wherein said first conductor comprises a copper layer.

14. A method as described in claim 12, wherein said dielectric comprises a polymer barium titanate layer.

15. A method as described in claim 12, wherein the display is less than 0.020 inch in thickness, including the substrate thickness.

16. A method as described in claim 12, in which the display is substantially flexible in opposite directions.

17. A method as described in claim 12, including providing a light-transmissive electrically conductive layer overlying said phosphor, and with said second electrical conductor overlying said light-transmissive layer.

18. A method as described in claim 17, wherein said light-transmissive electrically conductive layer comprises polymer indium oxide.

19. A method as described in claim 12, said second electrical conductors comprising conductive silver polymer ink.

20. A method as described in claim 12, wherein said first electrical conductors are electrically interconnected to form a column and said second electrical conductors are electrically interconnected to form a row.

21. A method of making an electroluminescent display comprising a matrix of individual light-emitting elements in a row and column formation and adapted for excitation from a voltage supply which addresses the matrix, which comprises the steps of:

providing a plurality of first electrical conductors overlying a substrate, said first electrical conductors comprising a copper layer;

screen printing a plurality of spaced dielectric islands overlying the first electrical conductors, said dielectric islands comprising a polymer barium titanate layer;

screen printing a plurality of spaced light-emitting phosphor islands overlying the dielectrics, said phosphor islands comprising a phosphor polymer layer;

providing a light-transmissive electrically conductive layer overlying said phosphor, said light-transmissive electrically conductive layer comprising polymer indium oxide;

providing a second electrical conductor overlying the light-transmissive layer and defining a window for enabling viewing of the phosphor islands, said second electrical conductor comprising a conductive silver polymer ink;

whereby voltage excitation by the voltage supply across the first electrical conductor and the second electrical conductor will cause light emission by the excited element.

22. A method as described in claim 21, wherein said first electrical conductors are electrically interconnected to form a column and said second electrical conductors are electrically interconnected to form a row; a plurality of parallel columns on said substrate and also a plurality of parallel rows, with said columns and rows being perpendicular to each other.

23. A process of making an electroluminescent display comprising a number of individual light-emitting elements in a selected formation and adapted for excitation from a voltage supply, which comprises the steps of:

providing a substrate;

providing an electrically conductive coating on said substrate;

etching said electrically conductive coating to provide a plurality of first electrical conductors overlying the substrate with each first electrical conductor forming a column;

screen printing a plurality of spaced dielectric islands over said first conductors, with each dielectric island corresponding to an individual light-emitting element;

screen printing spaced light-emitting phosphor islands overlying the dielectric islands; and screen printing a plurality of second electrical conductors overlying said phosphor in a direction transverse the direction of the first conductors.

24. A method of making an electroluminescent display comprising a matrix of individual light-emitting elements in a row and column formation and adapted for excitation from a voltage supply which addresses the matrix, which comprises the steps of:

providing an electrically non-conductive substrate;

laminating said substrate with a copper foil layer;

etching the copper foil layer to provide a plurality of first electrical conductors overlying the substrate with each first electrical conductor forming a column;

screen printing a plurality of spaced barium titanate dielectric islands over the first conductors;

screen printing a plurality of spaced phosphor polymer islands over the dielectric islands;

screen printing an indium oxide transmissive conductor layer over said phosphor polymer islands; and screen printing an electrically conductive silver polymer ink over said indium oxide transmissive conductive layer to provide a plurality of second electrical conductors in a direction transverse the direction of the first conductors, with each of said second electrical conductors forming a row.

* * * * *